US008783265B2

(12) United States Patent
Shakouri Moghadam

(10) Patent No.: US 8,783,265 B2
(45) Date of Patent: Jul. 22, 2014

(54) HUBBLE-BUBBLE DEVICE

(76) Inventor: Mohammad Javad Shakouri Moghadam, Tehran (IR)

( * ) Notice: Subject to any disclaimer, the term of this patent is extended or adjusted under 35 U.S.C. 154(b) by 782 days.

(21) Appl. No.: 12/835,268

(22) Filed: Jul. 13, 2010

(65) Prior Publication Data

US 2010/0275937 A1 Nov. 4, 2010

(51) Int. Cl.
*A24F 1/30* (2006.01)

(52) U.S. Cl.
USPC ..... 131/196

(58) Field of Classification Search
USPC ..... 131/173, 330, 193–196; 206/242–276
See application file for complete search history.

(56) References Cited

U.S. PATENT DOCUMENTS

| | | | | |
|---|---|---|---|---|
| 3,805,806 | A * | 4/1974 | Grihalva | 131/173 |
| 4,219,032 | A * | 8/1980 | Tabatznik et al. | 131/329 |
| 2007/0215164 | A1* | 9/2007 | Mehio | 131/173 |
| 2007/0215165 | A1* | 9/2007 | Mazakis | 131/257 |
| 2009/0178686 | A1* | 7/2009 | Nefraoui | 131/173 |

* cited by examiner

*Primary Examiner* — Richard Crispino
*Assistant Examiner* — Yana B Krinker
(74) *Attorney, Agent, or Firm* — Barry Choobin; Patent 360 LLC

(57) ABSTRACT

The various embodiments herein provide an efficient head for hubble-bubble device used in smoking and using tobacco with the capability of immediate tobacco replacement and easy regulation of the distance between charcoal and tobacco. A hubble-bubble device comprises the holder, the charcoal container arranged on top of the holder and the tobacco tray arranged on a bottom section of the holder. The tobacco tray is in the form of a drawer which provides for insertion and removal of the tobacco tray from the holder thereby facilitating quick replacement of the tobacco.

3 Claims, 12 Drawing Sheets

HUBBLE-BUBBLE DEVICE

BACKGROUND

1. Technical field

The embodiments herein generally relate to hubble-bubble device used in smoking and particularly relate to a heading section of the hubble-bubble device. The embodiments herein more particularly relate to the heading section provided with arrangements for quick tobacco replacement and adjusting a distance between the charcoal and the tobacco.

2. Description of the Related Art

Application history of the tobacco returns to many years ago and smoking plants for medical purposes and use of plants holding a tranquilizer or weak poisons was common. In this among, the use of hubble-bubble, with a small water reservoir in a lower section and tobacco in an upper section within a ceramic container placed over the hubble-bubble, has antiquity of hundreds years. In the hubble-bubble, suction imposes negative pressure and creates an airflow starting from the upper section of tobacco. The airflow passes through the blazing charcoal over the head of the hubble-bubble. The stroke of hot air with tobacco pieces placed underneath the charcoal results in a quick rise in the temperature of the tobacco pieces and the temperature increase accompanies an evaporation of the materials existing in the tobacco. The vapor enters into the water in the form of a white smoke through a pipe of the hubble-bubble and then to the upper section of the water container and comes out of the hubble-bubble with next suctions. The use of water in the lower section of the hubble-bubble reduces the temperature of the outgoing gases and the positive pressure imposed on the air coming out through the pipe gives a much pleasure to the smoker.

One of the existing techniques includes a closed end metal cylinder with small furrows, surrounded by the tobacco placed over the head of the hubble-bubble. The head of the hubble-bubble device is surrounded by charcoal pieces and/or using element placed around it to control temperature and avoid burning of tobacco. Another technique includes a special chamber for tobacco which preserves the space between the charcoal and the tobacco and avoids a burning of tobacco or a temperature increase. In another technique, the tobacco is placed within a piece of aluminum foil thereby creating an aluminum capsule. During a smoking process, the aluminum capsule is perforated and is placed over the heading section of the hubble-bubble to provide temperature required for smoking.

There are several disadvantages that exist with the conventional heating techniques. Aluminum is known to produce gases when heated that are harmful to the lungs. Additionally, the charcoal produces ashes that fall through the holes in the aluminum, which gets mixed with the tobacco thereby changing the flavor. Another disadvantage is that the charcoal is located on top of the tobacco, causing the tobacco to burn quickly resulting in a harsh smoke, and the heat often does not transfer to the tobacco on the bottom of the bowl. Still another disadvantage to the heating technique is the chance of bumping the hubble-bubble, causing the hot coals to fall on the floor or the user. Still yet another disadvantage is that the charcoal moves about the top of the foil due to vibration of the hubble-bubble during heating, which necessitates a constant repositioning of the charcoal. Yet another disadvantage is that stirring and/or replenishing of the tobacco within the bowl is difficult as one must remove the charcoal and foil from the top of the bowl in order to access the contents therein.

Furthermore, another problem of traditional hubble-bubble is the undue and uncontrollable increase of temperature and consequent burning of the used tobacco resulting in the sense of stinging in the respiratory duct of the smoker. The prevailing problems further include the impossibility of replacing the tobacco without replacing the charcoals over the heading section, and lack of access to the tobacco for checking the quantity and the quality of the remaining tobacco.

Hence, there is a need for an improved hubble-bubble device that eliminates the problem of temperature rise in hubble-bubble device. There also exists a need to provide a hubble-bubble device with facilitates a replacement of a tobacco without replacing the charcoals over the heading section. Furthermore, there exists a need for a hubble-bubble device which provides an access to the tobacco for checking the quantity and the quality of the tobacco remaining in a tobacco holder.

The abovementioned shortcomings, disadvantages and problems are addressed herein and which will be understood by reading and studying the following specification.

OBJECTS OF THE EMBODIMENTS

The primary object of the embodiments herein is to provide an improved hubble-bubble device which prevents a burning of the tobacco while smoking.

Another object of the embodiments herein is to provide a hubble-bubble device which controls a rate of temperature around a tobacco holder.

Yet another object of the embodiments herein is to provide a hubble-bubble device which facilitates a quick replacement of the charcoal and the tobacco when the tobacco is burned or it is not per palate of user.

Yet another object of the embodiments herein is to provide a hubble-bubble device which facilitates to vary the distance of the charcoal from the tobacco for controlling the heat around the tobacco.

Yet another object of the embodiments herein is to provide a hubble-bubble device which avoids a scattering of the ash of a flamed charcoal.

These and other objects and advantages of the embodiments herein will become readily apparent from the following detailed description taken in conjunction with the accompanying drawings.

SUMMARY

A hubble-bubble device for a smoking apparatus comprises a holder, a charcoal container arranged on top of the holder and a tobacco tray arranged on a bottom section of the holder. The charcoal container further includes at least two knobs arranged on opposite sides of the charcoal container and the tobacco tray includes at least one knob for an insertion and a withdrawal of the tobacco tray from the holder. The holder is provided with the threads on at least one of an outer surface and an inner surface for receiving the charcoal container. The holder and the charcoal container of the hubble-bubble device are made of ceramic and the tobacco tray is made of ceramic or metal.

According to one embodiment herein, the hubble-bubble device further comprises a container base and a re-movable charcoal container. The re-movable charcoal container is adapted to be inserted into the container base provided with a casing. The container base includes the inclined trenches so that the trenches are arranged on the opposite sides of the casing of the container base to vary the distance of the re-movable charcoal container from the tobacco for adjusting the distance between the charcoal and the tobacco. The design of the inclined trenches can be in furrow form or a straight form. The hubble-bubble device further comprises a plurality of pins to plug the movable charcoal container and the container base into the hubble-bubble device.

The charcoal container further includes two knobs arranged on the opposite sides of the charcoal container. The knobs are adapted to engage with the grooves provided along the casing of the container base to provide a tight fit of the charcoal container on the container base and also to slide the charcoal container along the inclined trenches to adjust the distance between the charcoal and the tobacco.

According to one embodiment herein, the hubble-bubble device further comprises a holder, a charcoal container, a handle provided on at least one end of the charcoal container, a tobacco tray arranged on a bottom section the holder. The casing of the holder is provided with a plurality of furrows to receive and hold the handle of the charcoal container so as to adjust the distance of the charcoal container from the tobacco tray to prevent burning of the tobacco during smoking. The plurality of furrows is defined in at least one of a staircase form and thread form.

The tobacco tray includes at least one knob for an insertion and a withdrawal of the tobacco tray from the holder. Further the charcoal container includes a corkscrew to facilitate the placement of the charcoal container inside the holder of the hubble-bubble device. The corkscrews/knob on the charcoal container regulates the distance from the charcoal container to the tobacco tray. The charcoal container is rotated and moved along the furrows on the casing of the holder to regulate the distance between the charcoal and tobacco. The hubble-bubble device further comprises a lid in the bottom section of the holder to prevent the scattering of an ash of a flamed charcoal.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Although the specific features of the embodiments herein are shown in some drawings and not in others, this is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1:
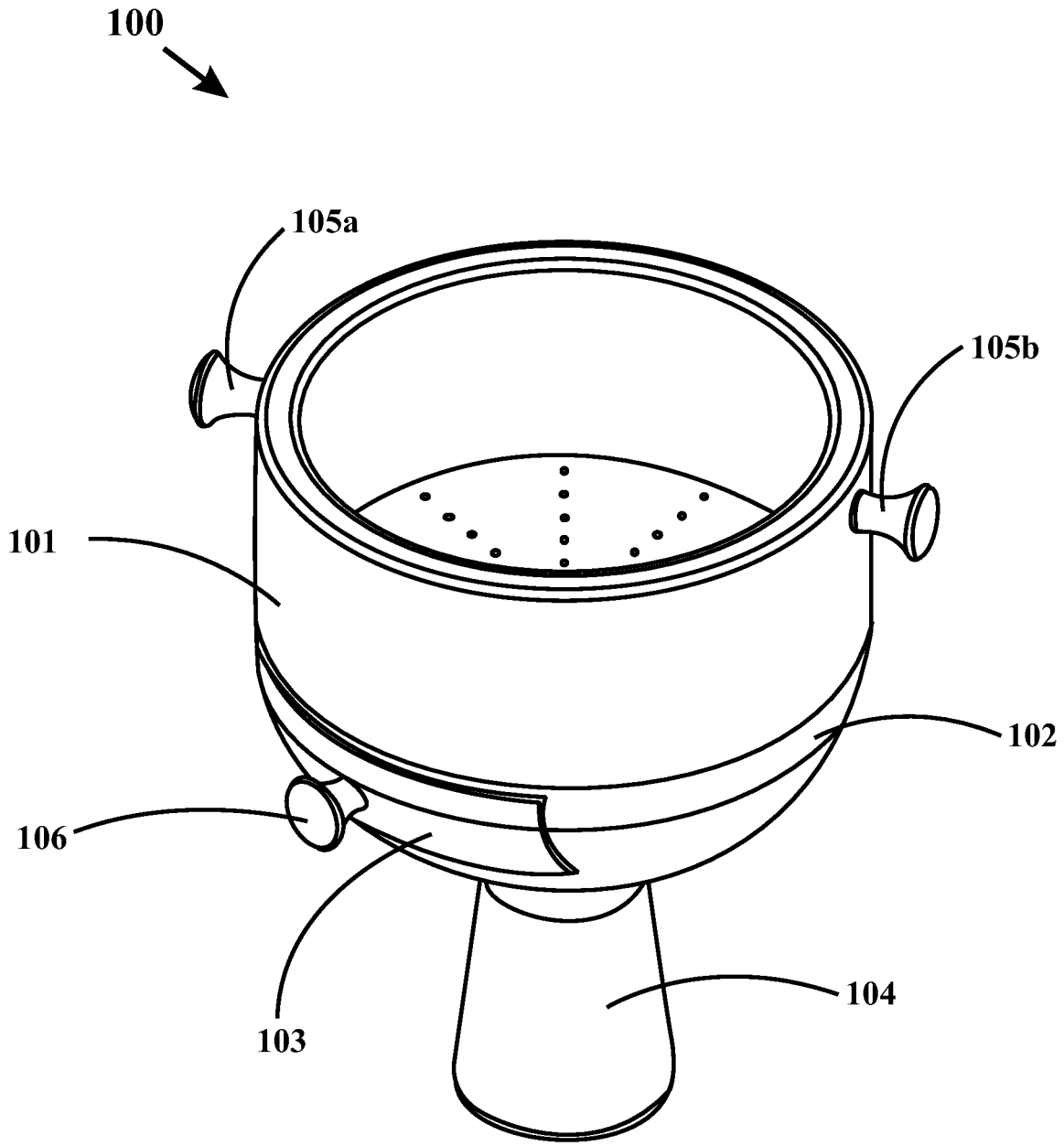
FIG. 1 illustrates a front view of the heading section of the hubble-bubble device according to an embodiment of the present disclosure.
Figure 2:
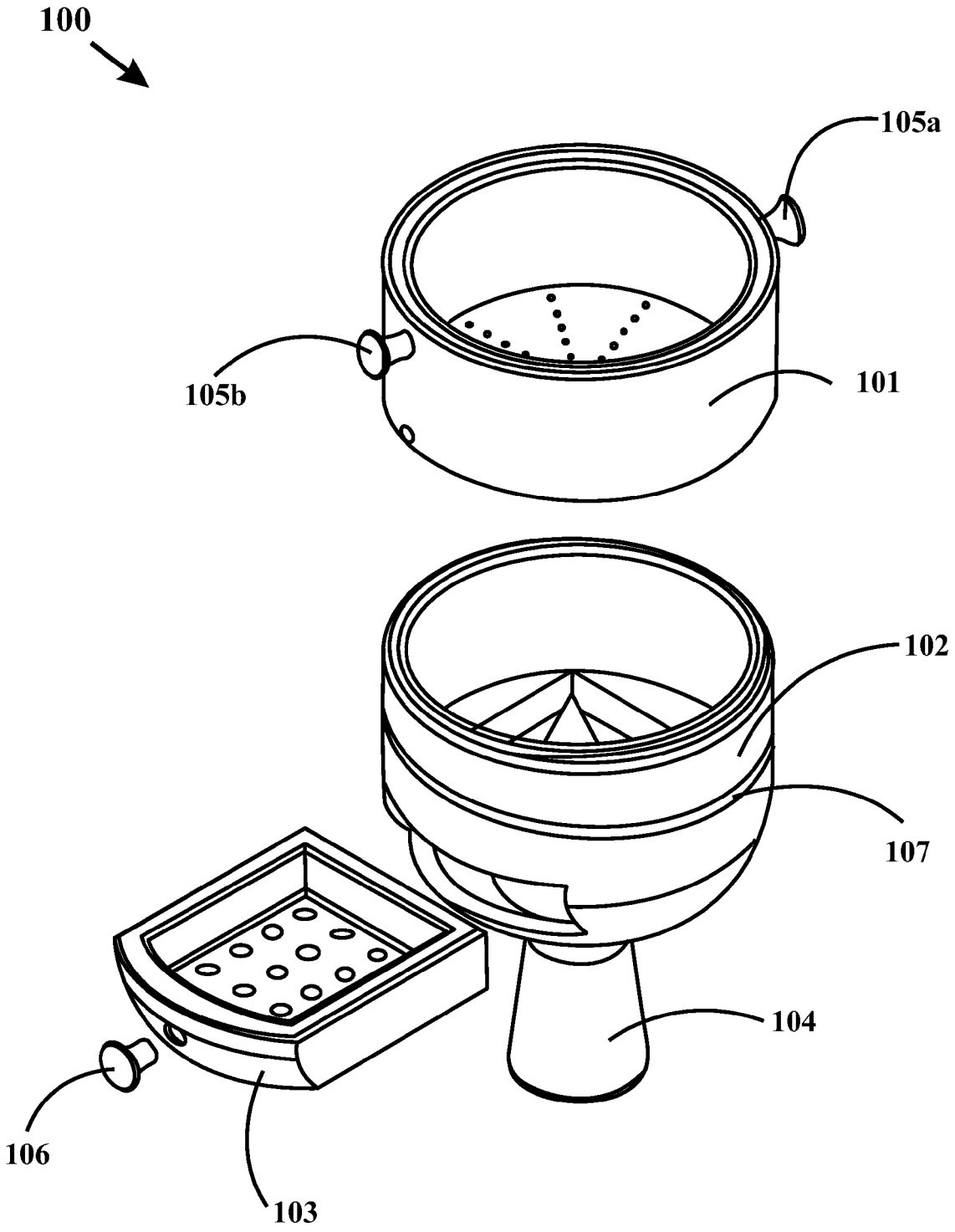
FIG. 2 illustrates an exploded view of the heading section of the hubble-bubble device according to an embodiment of the present disclosure.

The various embodiments herein provide a hubble-bubble used in a smoking apparatus and particularly to a heading section of the hubble-bubble device. FIG. 1 illustrates a front view of the heading section of the hubble-bubble device according to an embodiment of the present disclosure and FIG. 2 illustrates an exploded view of the hubble-bubble device. The charcoal container 101 is arranged on top of a holder and a tobacco tray is arranged on a bottom section of the holder. The charcoal container 101 is provided with two knobs 105*a* and 105*b* placed on opposite sides of the casing of the holder. The charcoal container is provided with threads 107 on the inner wall for screwing the charcoal container 101 to the holder. The holder 102 is provided with the threads 107 and/or staircase or any other form as shown in FIG. 2 on the outside wall for screwing/fixing the charcoal container 101 on the holder 102 of the hubble-bubble device. The charcoal is placed inside the charcoal container 101 and the tobacco is placed inside the tray 103 provided at the bottom section of the hubble-bubble device as shown in FIG. 1 and FIG. 2.

Knob 106 is provided on the tray 103 to insert and remove tray 103 from the hubble-bubble device. The tobacco tray 103 is made of metal or ceramic for placing a tobacco. The arrangement facilitates a placement of the charcoal container 101 inside the head of hubble-bubble and regulation of the distance of the charcoal container 101 from the surface of the tobacco tray 103. The lower section 104 of a heading section 100 is connected to the body of the hubble-bubble device 100 to complete the assembly of the hubble-bubble device 100.

Figure 3:
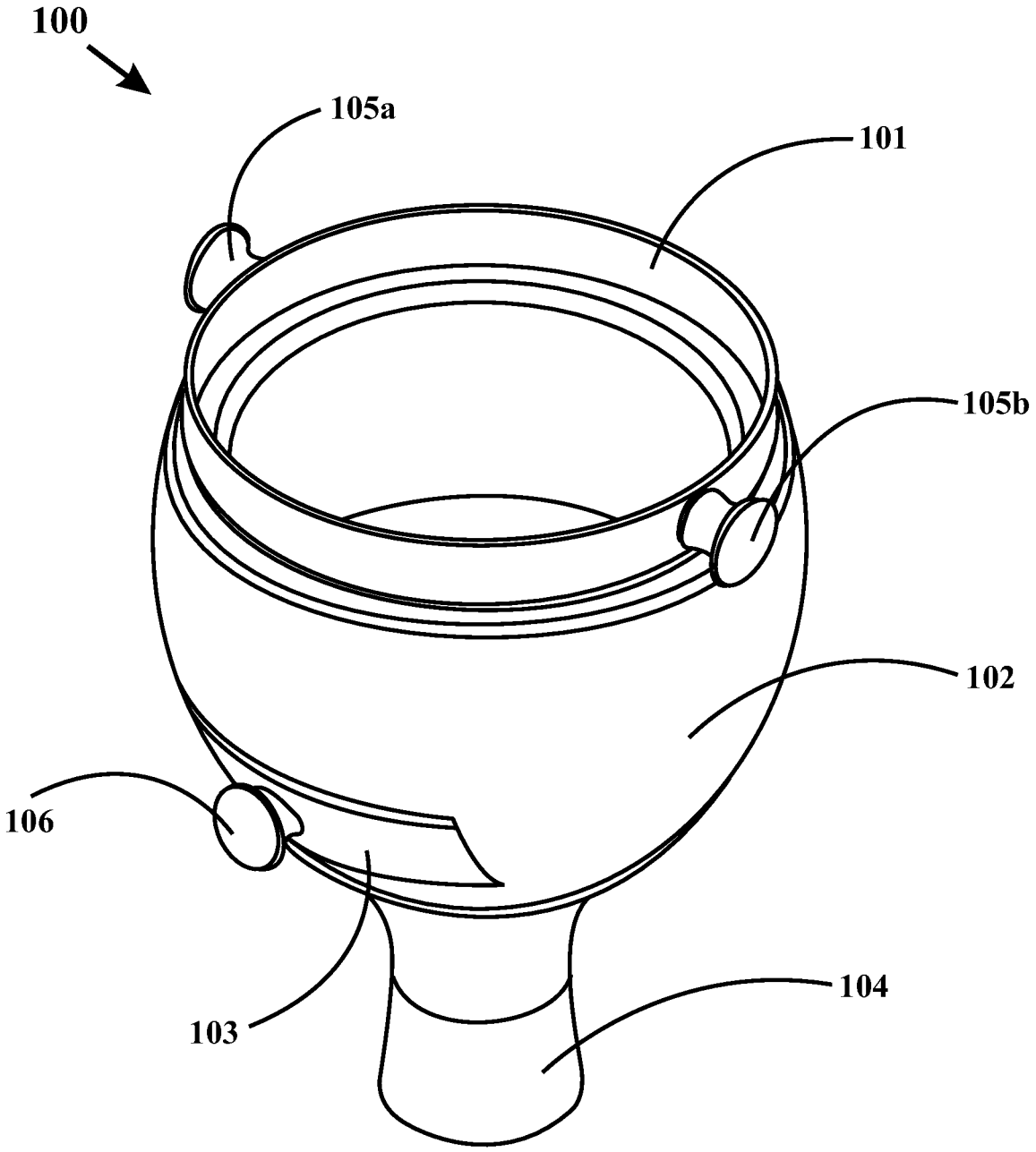
FIG. 3 illustrates a front view of the heading section of the hubble-bubble device with the ceramic container placed inside the ceramic cylinder according to another embodiment of the present disclosure.

FIG. 3 illustrates a front view of the heading section of the hubble-bubble device showing the charcoal container, the holder and the tray according to an embodiment of the present disclosure. The charcoal container 101 is provided with two knobs 105*a* and 105*b* placed on opposite sides on the casing and the said charcoal container 101 is placed inside the holder 102 as shown in FIG. 3. The charcoal is placed inside the charcoal container 101 and the tobacco is placed inside the tray 103 provided at the bottom section of the heading section 100 of the hubble-bubble device as shown in FIG. 3. A handle 106 is provided on the tray 103 to insert and remove the tray 103 from the heading section 100 of the hubble-bubble device. The lower section 104 of the heading section 100 is connected to the body of the hubble-bubble device to complete the assembly of the hubble-bubble device.

Figure 4:
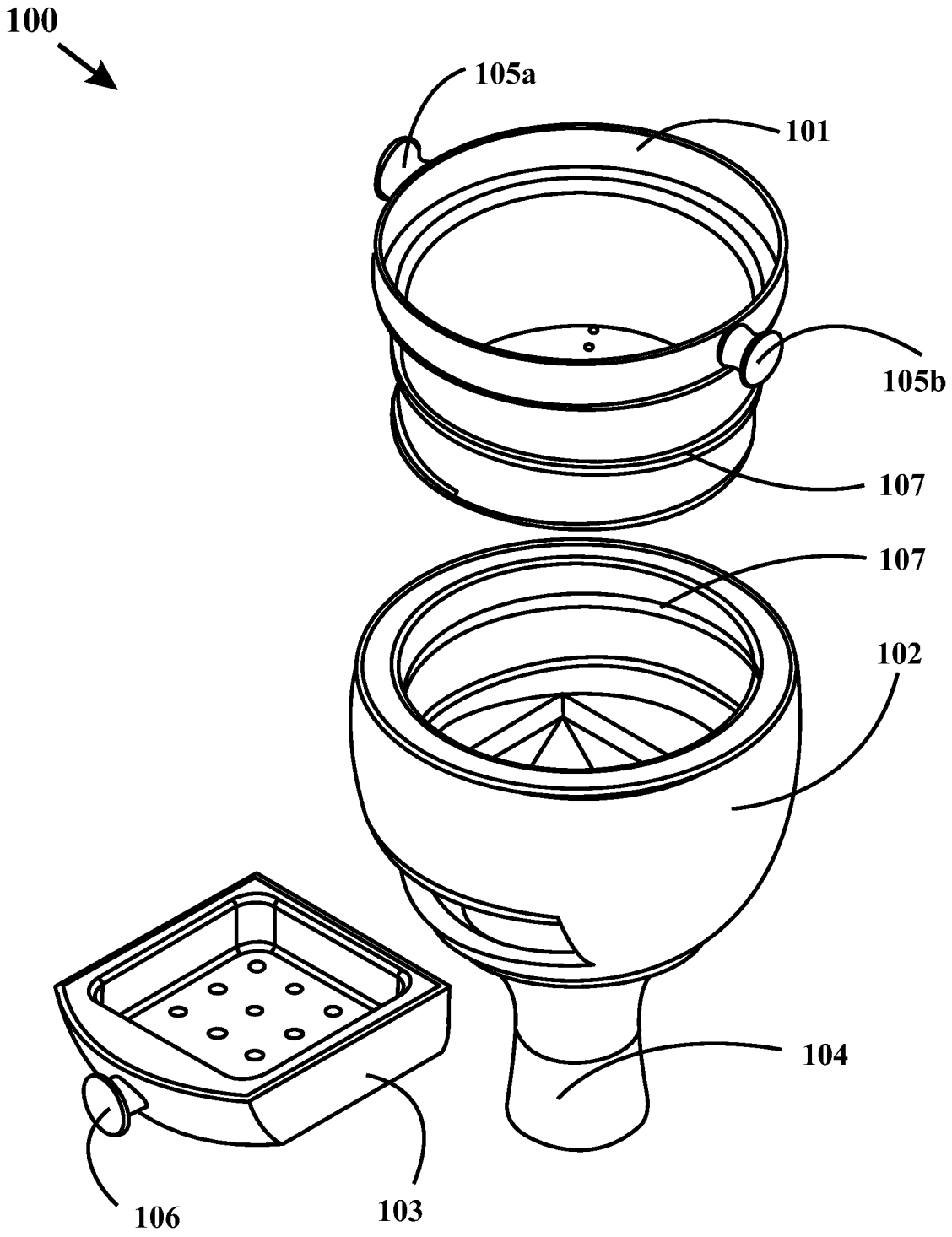
FIG. 4 illustrates an exploded view of the heading section of the hubble-bubble device according to another embodiment of the present disclosure.

FIG. 4 illustrates an exploded view of the heading section of the hubble-bubble device showing the charcoal container, the holder and the tray according to an embodiment of the present disclosure. The charcoal container 101 is provided with two knobs 105*a* and 105*b* placed on opposite sides on the casing and the threads 107 are formed on the outer wall of the charcoal container 101 for screwing. The holder 102 is provided with the threads 107 and/or staircase or any other form as shown in FIG. 4 on the inner wall for screwing/fixing the charcoal container 101 inside the holder 102 of the hubble-bubble device. The charcoal is placed inside the charcoal container 101 and the tobacco is placed inside the tray 103 provided at the bottom section of the heading section 100 of the hubble-bubble device as shown in FIG. 3 and FIG. 4. A handle 106 is provided on the tray 103 to insert and remove the tray 103 from the heading section 100 of the hubble-bubble device. The tray 103 is made of metal or ceramic for placing the tobacco. The arrangement facilitates a placement of the charcoal container 101 inside the head of hubble-bubble and to regulate the distance of the charcoal container 101 from the surface of the tobacco tray 103. The lower section 104 of the heading section 100 is connected to the body of the hubble-bubble device to complete the assembly of the hubble-bubble device.

Figure 5:
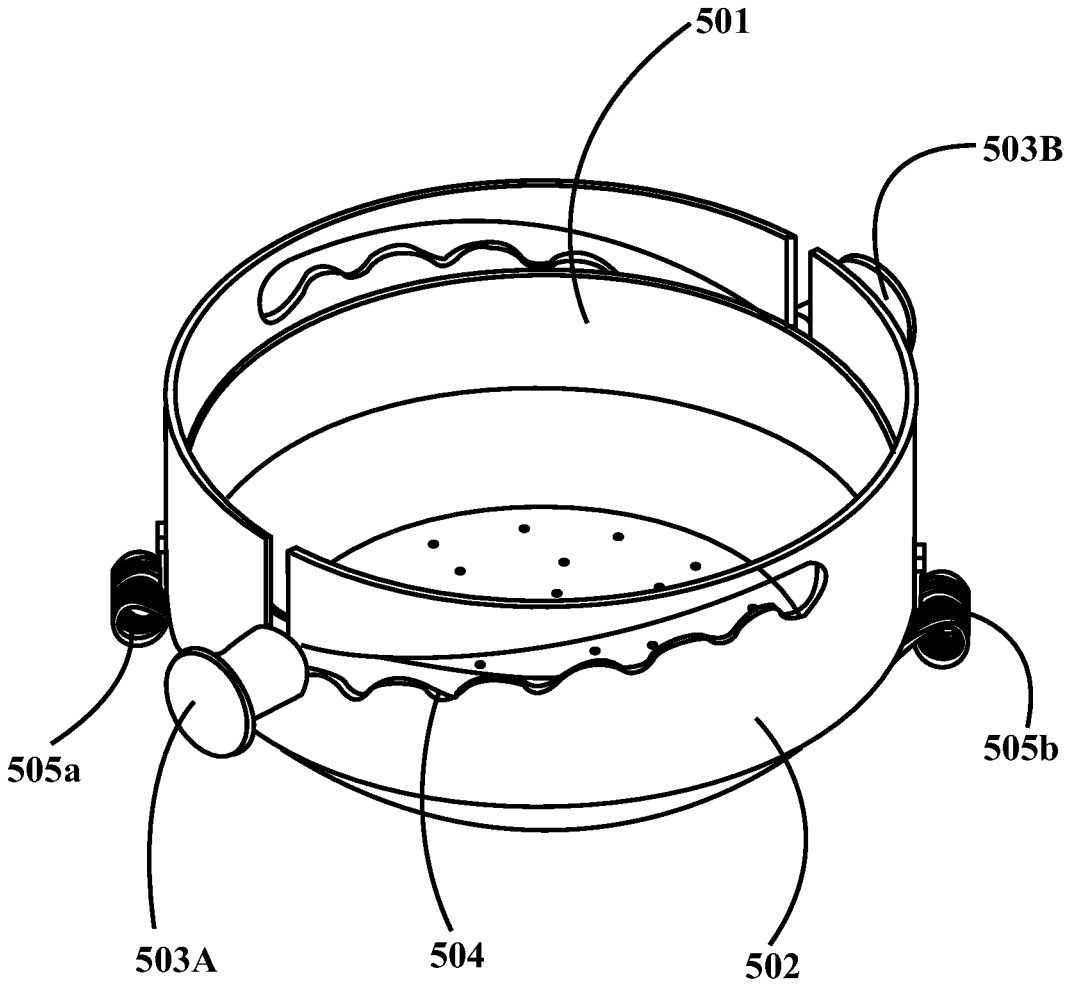
FIG. 5 illustrates a perspective view of a charcoal container of the hubble-bubble device according to another embodiment of the present disclosure.

FIG. 5 illustrates the perspective view of a charcoal container arranged inside a hubble-bubble device with furrows according to an embodiment of the present disclosure. The hubble-bubble device comprises a container base 502 and the re-movable charcoal container 501. The re-movable charcoal container 501 is adapted to be inserted into the container base 502. The re-movable charcoal container 501 is provided with corkscrews/knob 503*a* and 503*b* and/or special protrusions that facilitate placement of re-movable charcoal container 501 inside the container base 502 as shown in FIG. 5. The container base 502 is further provided with inclined furrows 504 on the opposite sides of the casing to regulate the distance from the surface of the tobacco tray 103. The container pins 505*a* and 505*b* are provided to plug the container base 502 along with the re-movable charcoal container 501 in the heading section 100 of a device housing in the hubble-bubble device.

Figure 6:
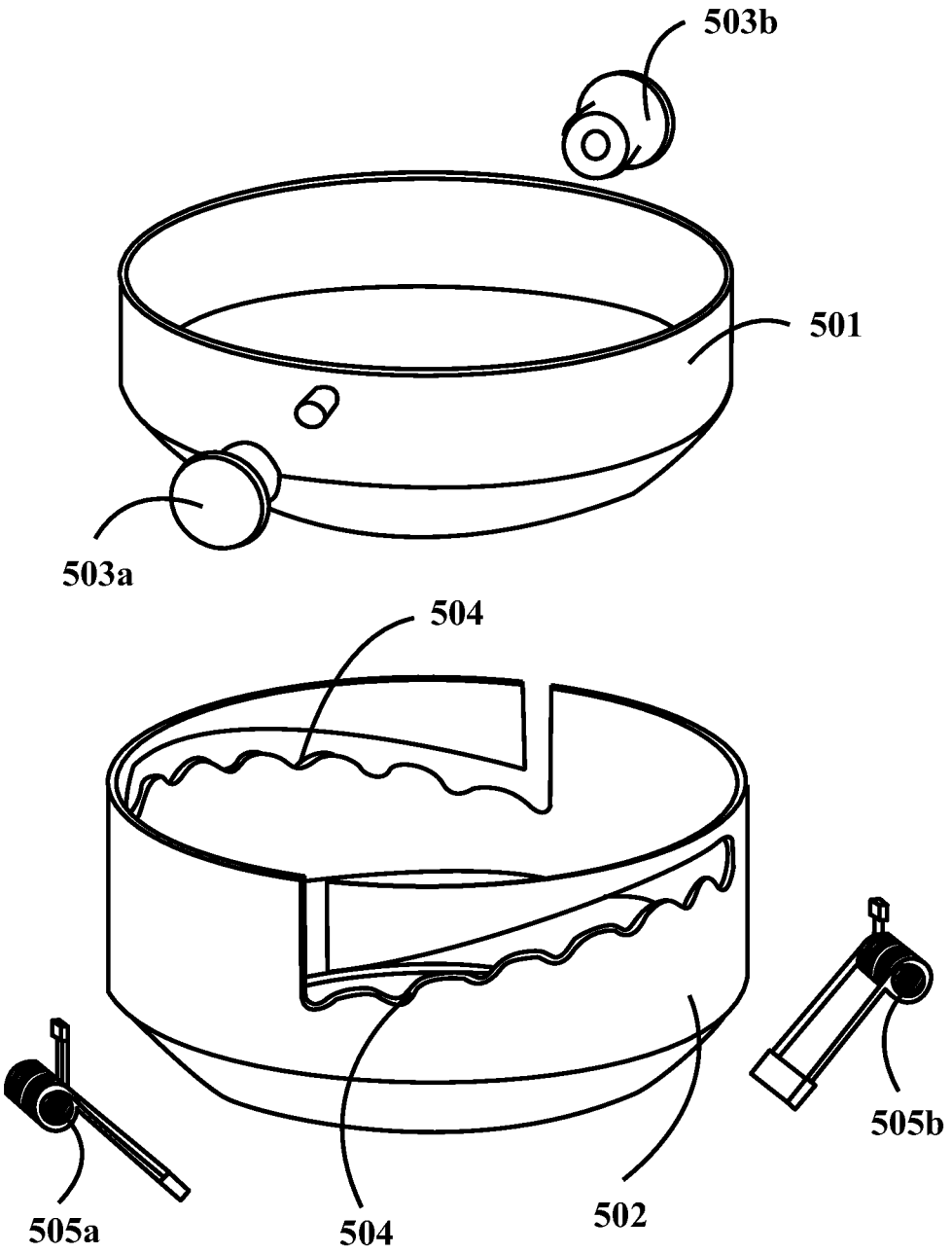
FIG. 6 illustrates the exploded view of the charcoal container of the hubble-bubble device according to another embodiment of the present disclosure.

FIG. 6 illustrates the exploded view of a charcoal container (with furrows) for a hubble-bubble device according to an embodiment of the present disclosure. With respect to FIG. 6, the hubble-bubble device comprises a container base 502 and the re-movable charcoal container 501. The re-movable charcoal container 501 is adapted to be inserted into the container base 502. The re-movable charcoal container 501 is provided with corkscrews/knob 503*a* and 503*b* and/or special protrusions that facilitate placement of re-movable charcoal container 501 inside the container base 502 as shown in FIG. 5 and FIG. 6. The container base is provided with longitudinally extending grooves along the sides of the casing to facilitate the placement of re-movable charcoal container 501 inside the container base 502 of the hubble-bubble device. The container base 502 is further provided with inclined furrows 504 on the opposite sides of the casing to regulate the distance of the charcoal container from the surface of the tobacco tray 103. The inclined furrows 504 provided on the container base 502 helps in the adjustment of distance between the re-movable charcoal container 501 from the tray 103 provided in the bottom section of the heading section 100 of the hubble-bubble device. The container pins 505*a* and 505*b* are provided to plug the container base 502 along with the re-movable charcoal container 501 in the heading section 100 of a device housing in the hubble-bubble device.

Figure 7:
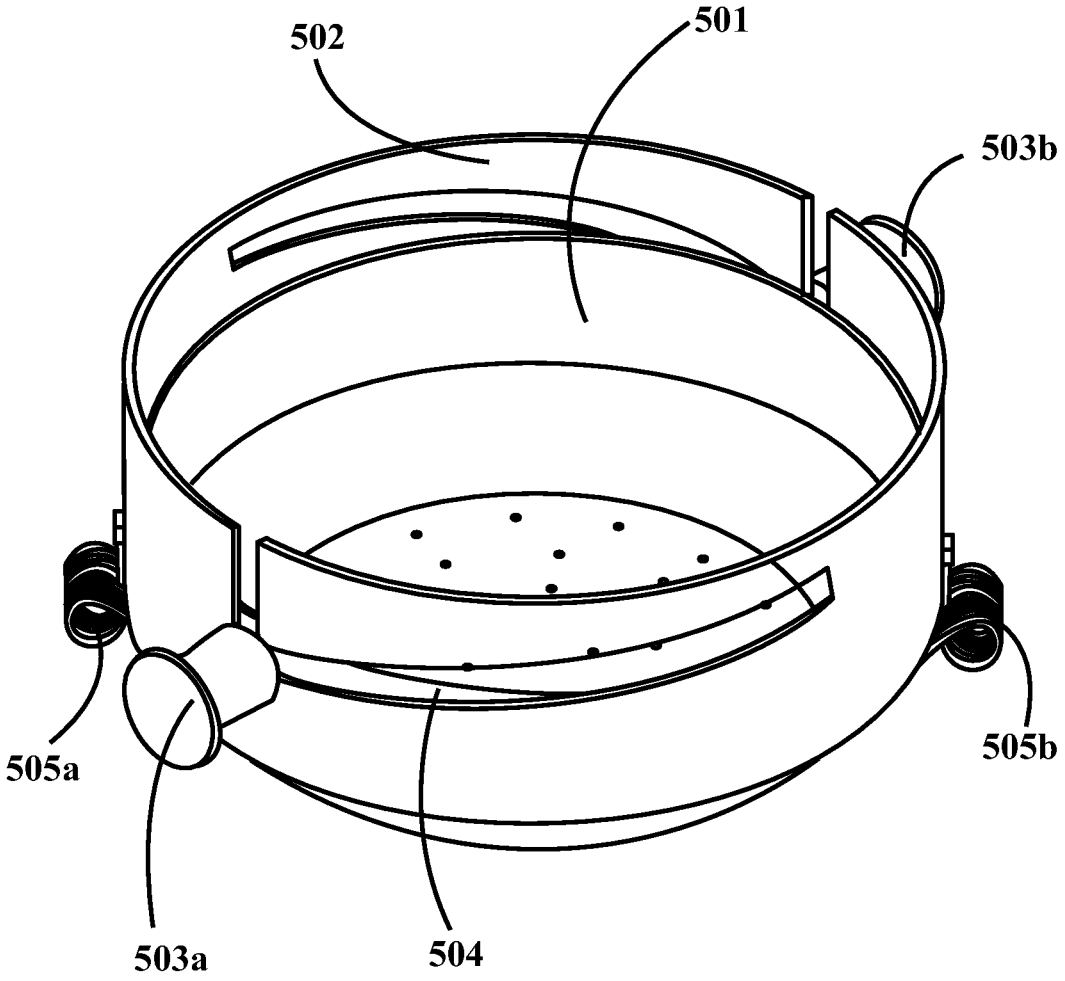
FIG. 7 illustrates the perspective view of the charcoal container with an inclined trench according to another embodiment of the present disclosure.

FIG. 7 illustrates a perspective view of a charcoal container (with an inclined trench) for a hubble-bubble device according to one embodiment of the present disclosure. With respect to FIG. 7, the re-movable charcoal container 501 is provided with corkscrews/knob 503*a* and 503*b* and/or special protrusions that facilitate the placement of the re-movable charcoal container 501 inside the container base 502. The container base 502 is provided with the inclined trench 504 on the opposite sides of the casing to facilitate the placement of re-movable charcoal container 501 inside the container base 502 of the hubble-bubble device. The container pins 505*a* and 505*b* are provided to plug the container base 502 along with the re-movable charcoal container 501 in the heading section 100 of a device housing in the hubble-bubble device.

Figure 8:
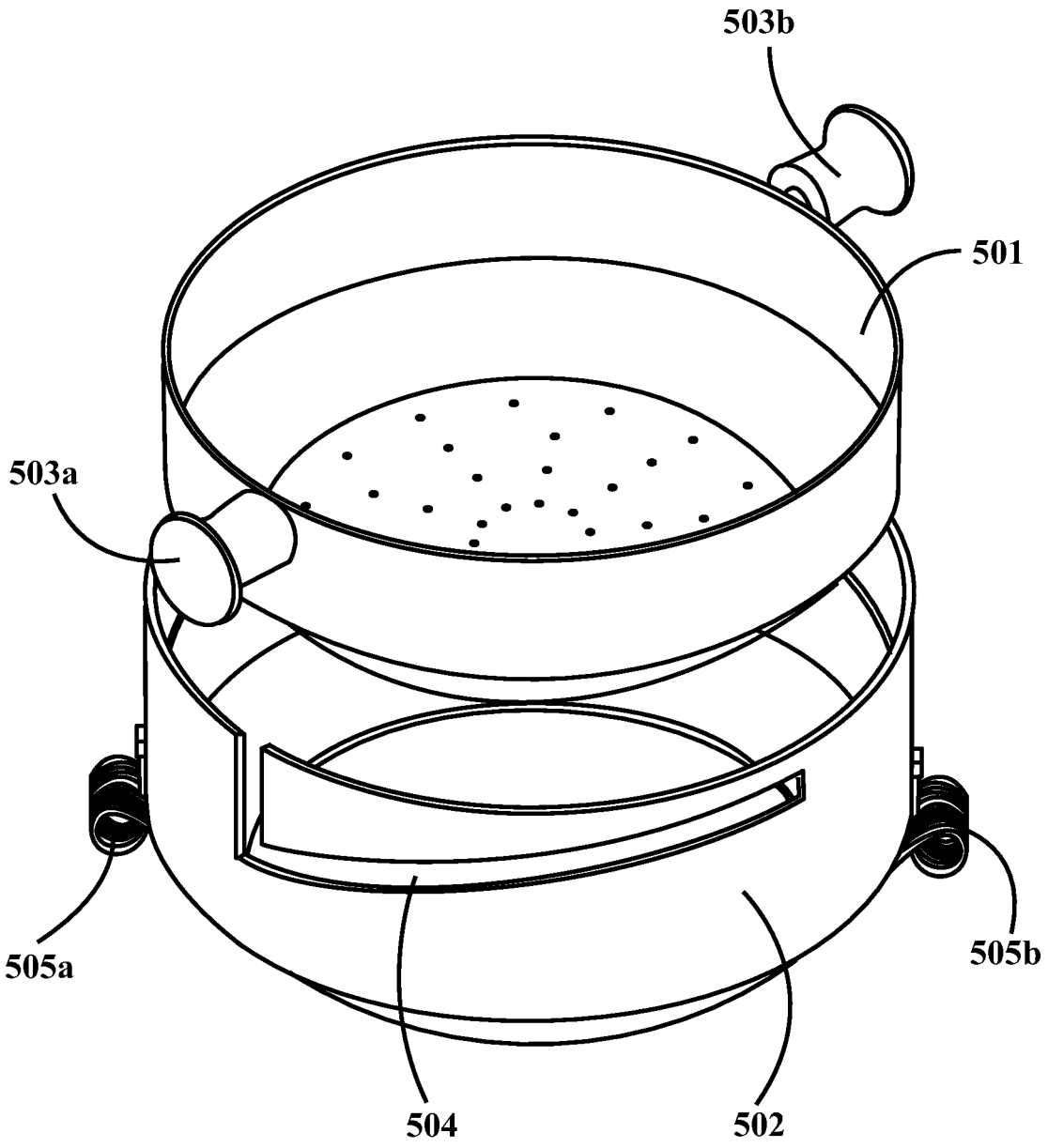
FIG. 8 illustrates an exploded view of the charcoal container with an inclined trench for a hubble-bubble device according to one embodiment of the present disclosure.

FIG. 8 illustrates an exploded view of a charcoal container (with an inclined trench) for the hubble-bubble device according to one embodiment of the present disclosure. The re-movable charcoal container 501 is provided with corkscrews/knob 503*a* and 503*b* and/or special protrusions that facilitate the placement of the re-movable charcoal container 501 inside the container base 502 as shown in FIG. 7 and FIG. 8. The container base 502 is provided with the inclined trench 504 on the opposite sides of the casing to facilitate the placement of re-movable charcoal container 501 inside the container base 502 of the hubble-bubble device and to regulate the distance of the container 501 from the surface of the tobacco tray 103. The inclined trench 504 provided on the container base 502 helps in the adjustment of a distance between the re-movable charcoal container 501 from the tray 103 provided in the bottom section of the heading section 100 of the hubble-bubble device. The container pins 505*a* and 505*b* are provided to plug the container base 502 along with the re-movable charcoal container 501 in the heading section 100 of the hubble-bubble device.

Figure 9:
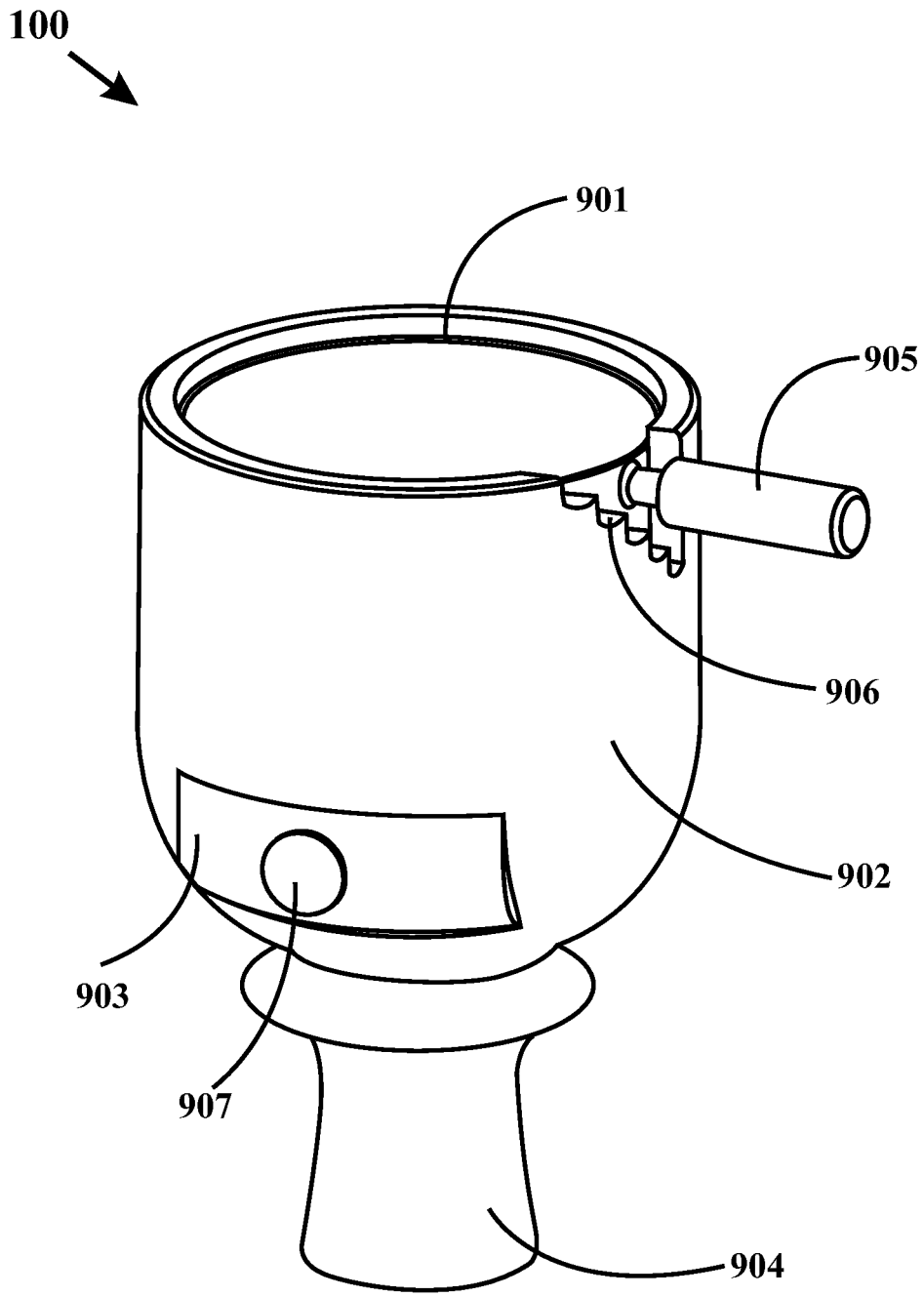
FIG. 9 illustrates a front view of the heading section of the hubble-bubble device with the ceramic container placed inside the ceramic cylinder having a furrow extending along a casing according to an embodiment of the present disclosure.

FIG. 9 illustrates the front view of the heading section of the hubble-bubble device with the charcoal container placed inside the holder having furrow extending along a casing according to an embodiment of the present disclosure. The charcoal container 901 is provided with the corkscrew/knob 905 and/or special protrusions that facilitate a placement of the charcoal container 901 inside the holder 902 of the heading section 100 of the hubble-bubble device. The holder 902 is provided with the furrows 906 that are in the form of thread and/or staircase or any other form which is extended along the casing as shown in FIG. 9. With the placement of tobacco over the tobacco tray 903 and with the placement of the tobacco tray 903 in its place, the replacement of the tobacco tray 903 and the tobacco is possible at every time.

Figure 10:
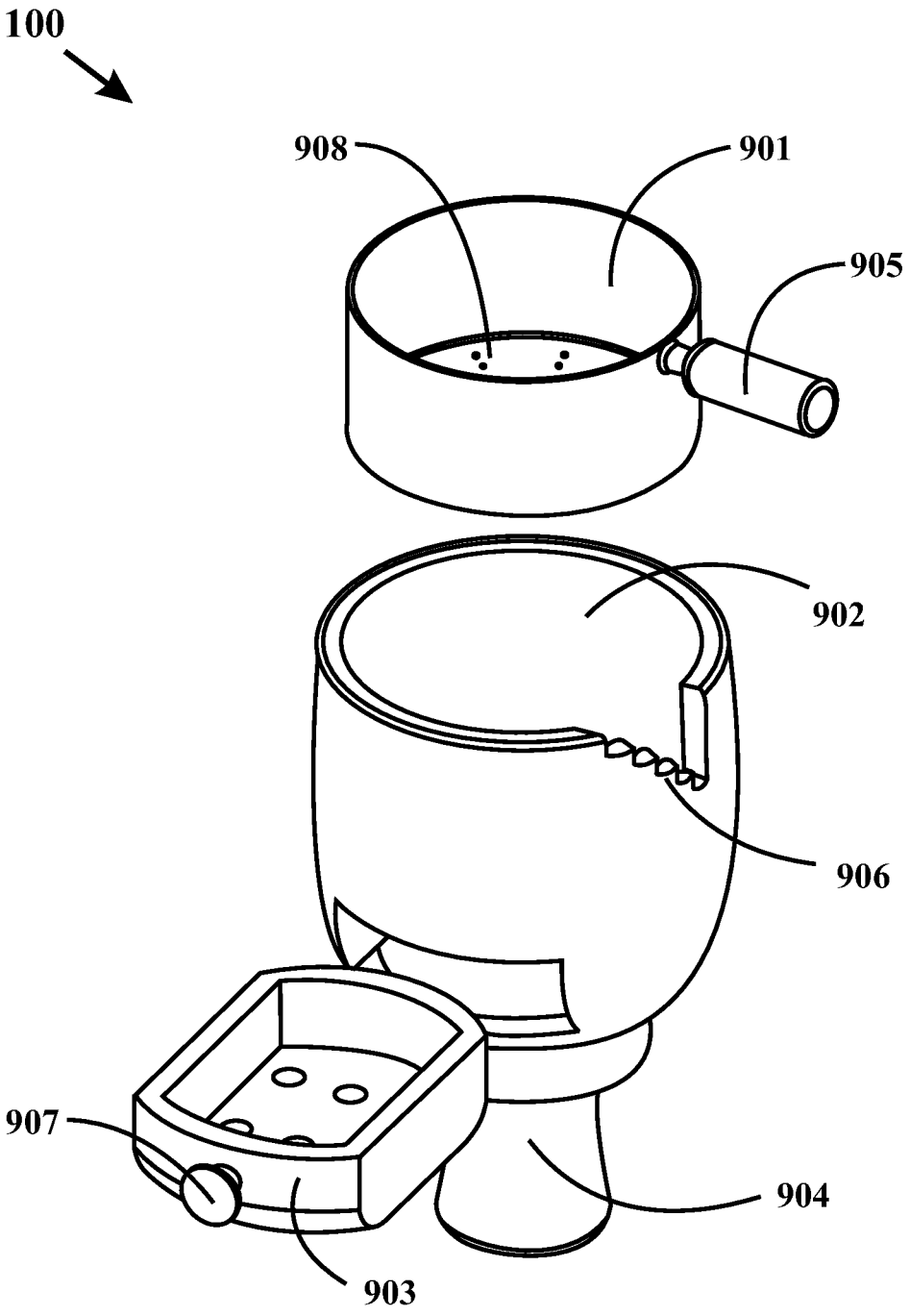
FIG. 10 illustrates an exploded view of the heading section of the hubble-bubble device showing the ceramic container, the ceramic cylinder with furrow extending along a casing and a tray according to an embodiment of the present disclosure.

FIG. 10 illustrates an exploded view of the heading section of the hubble-bubble device with the charcoal container placed inside the holder having furrow extending along a casing according to an embodiment of the present disclosure. The charcoal container 901 is provided with the corkscrew/knob 905 and/or special protrusions that facilitate the placement of charcoal container 901 inside the holder 902 of the heading section 100 of the hubble-bubble device. The charcoal container 901 in its flooring section include a circular piece 908 made of metal that is used as the board for placing a charcoal. The holder 902 is provided with the furrows 906 that are in the form of thread and/or staircase or any other form and are extended along the casing as shown in FIG. 9 and FIG. 10. With the placement of the tobacco over the tobacco tray 903 and with the placement of tobacco tray 903 in its place, the replacement of tray 903 and tobacco is possible in each time of use.

The tray 903 is provided with the knob 907 to pull-out and push-in the tray 903 containing tobacco in the hubble-bubble device. With the placement of a charcoal in the charcoal container 901, depending on the form of the piece, the distance from flamed charcoals up to the placement site of the tobacco can be adjusted. This avoids the burning of the tobacco during a smoking by rotating the piece and moving it over the furrows 906 existing inside the heading section 100 of the hubble-bubble. The charcoal container is provided with a lid (not shown) to avoid a scattering of the ash of the flamed charcoal. The lower section 904 of the heading section 100 is connected to the body of the hubble-bubble device.

Figure 11:
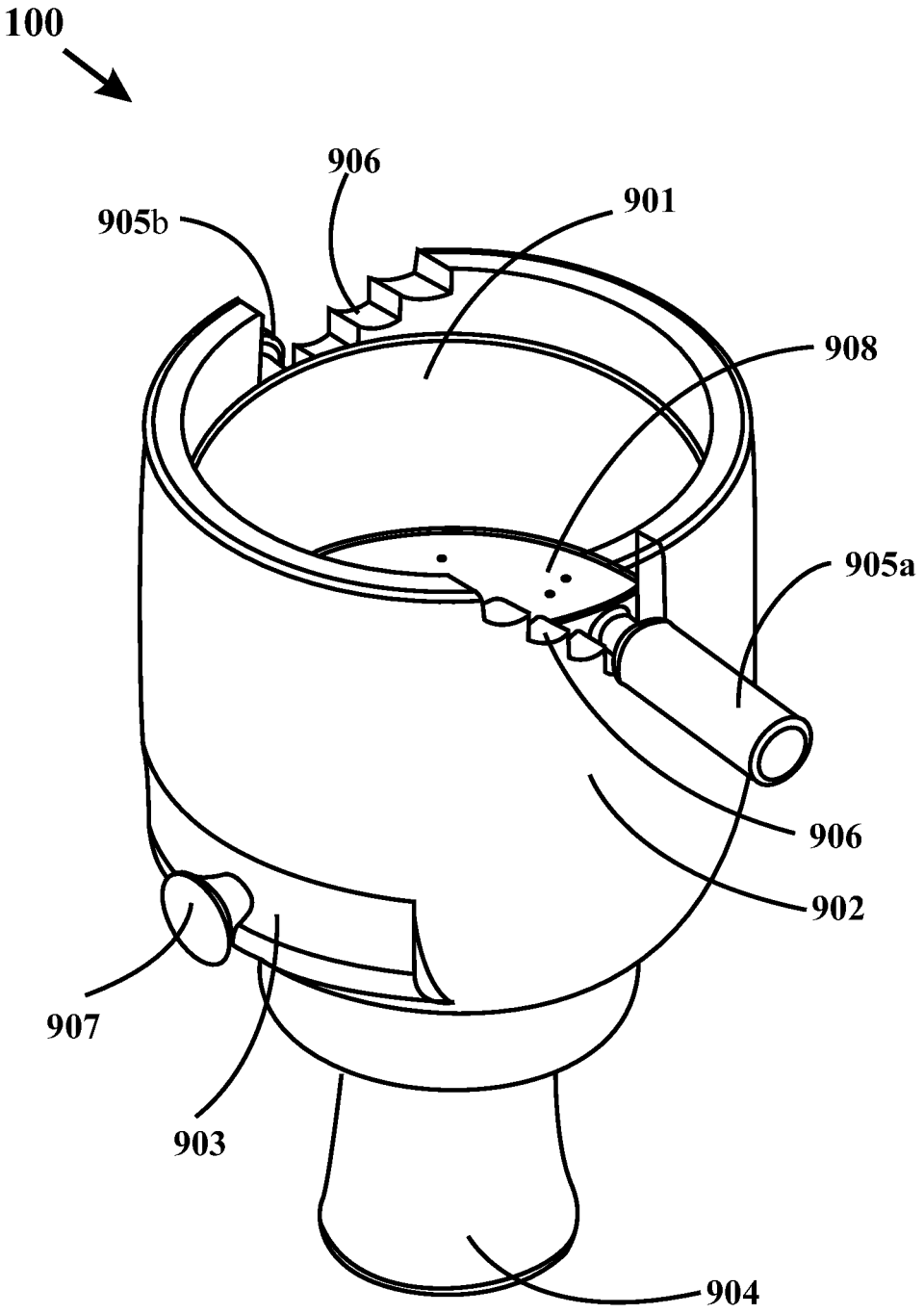
FIG. 11 illustrates a front view of the heading section of the hubble-bubble device with the ceramic container placed inside the ceramic cylinder having a plurality of furrows along a casing according to an embodiment of the present disclosure.

FIG. 11 illustrates a front view of the heading section of the hubble-bubble device with the charcoal container placed inside the holder having a set of furrows (placed opposite to each other) along a casing according to an embodiment of the present disclosure. The charcoal container 901 is provided with the corkscrews/knob 905*a* and 905*b* and/or special protrusions that facilitate the placement of the charcoal container 901 inside the holder 902 of the heading section 100 of the hubble-bubble device. The holder 902 is provided with the set of furrows 906 placed on the opposite sides on the holder 902 casing as shown in FIG. 11. The charcoal container 901 in its flooring section holds a circular piece 908 made of metal that is used as the board for placing charcoal. With the placement of the tobacco over the tray 903 and with the placement of the tobacco tray 903 in its place, the replacement of the tobacco tray 903 and the tobacco is possible in each time of use.

Figure 12:
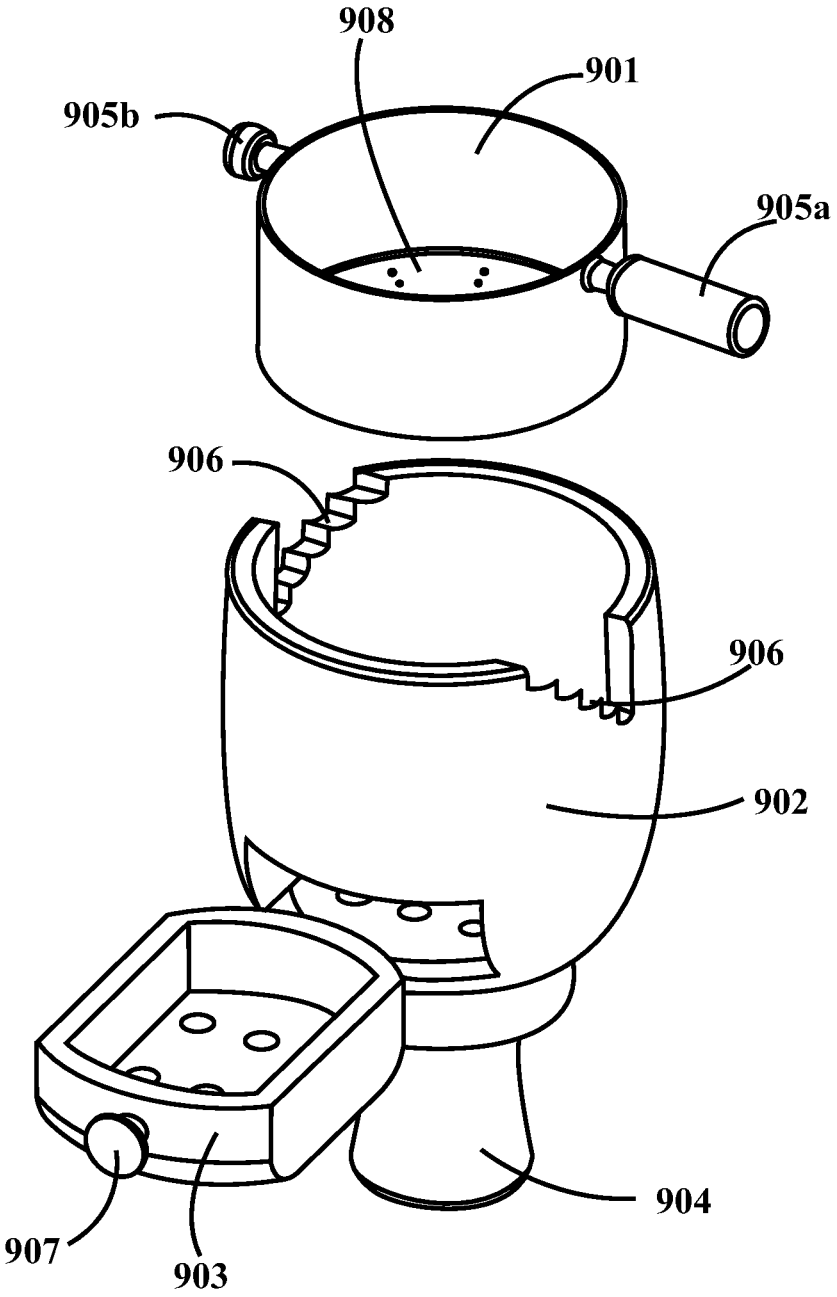
FIG. 12 illustrates an exploded view of the heading section of the hubble-bubble device showing the ceramic container, the ceramic cylinder with a plurality of furrows along a casing and the tray according to an embodiment of the present disclosure.

FIG. 12 illustrates an exploded view of the heading section of the hubble-bubble device with the charcoal container placed inside the holder having a set of furrows (placed opposite to each other) along a casing according to an embodiment of the present disclosure. The charcoal container 901 is provided with the corkscrews/knob 905*a* and 905*b* and/or special protrusions that facilitate placement of the charcoal container 901 inside the holder 902 of the heading section 100 of the hubble-bubble device. The holder 902 is provided with the set of furrows 906 placed on the opposite sides on the holder 902 casing in the form of thread and/or staircase or any other form that is extended along the casing as shown in FIG. 11 and FIG. 12. Charcoal container 901 in its flooring section may hold a circular piece 908 made of metal that is used as the board for placing the charcoal. With the placement of the tobacco over the tray 903 and with the placement of tobacco tray 903 in its place, the replacement of tray 903 and the tobacco is possible in each time of use.

The tray 903 is provided with the knob 907 to pull-out and push-in the tray 903 containing a tobacco in to the hubble-bubble device. With the placement of a charcoal in the charcoal container 901, depending on the form of the piece, one can adjust the distance from flamed charcoals up to the placement site of the tobacco and avoid the burning of the tobacco during the smoking by rotating the charcoal container 901 and moving it over the furrows 906 existing on the casing of the holder in the heading section 100 of the hubble-bubble device. The charcoal container is provided with a lid (not shown) to avoid the scattering of the ash of flamed charcoal. The lower section 904 of the heading section 100 is connected to the body of the hubble-bubble device.

One of the advantages of the proposed heading section of the hubble-bubble device is a quick replacement of a tobacco and easy regulation of the distance between the charcoal and the tobacco. The distance regulation mechanism provided in the heading section prevents a burning of the tobacco due to an excess heat from the charcoal. The rate of the temperature required for the effective functioning of the smoking apparatus is controlled through the proposed design and mechanism. Also it permits the increase of a heat for increasing the density of smoke of hubble-bubble in the case of coal shortage. The embodiment herein provides for an easy replacement of any part in case of damage of the part. The drawer type design for the tobacco tray provides for checking the quantity and quality of the tobacco present in the tobacco tray during the smoking process. The embodiment disclosed herein is suitable for any climate.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A hubble-bubble device for a smoking apparatus, the hubble-bubble device comprising:

a head section connected to a body of the hubble-bubble device;

wherein the head section comprises:

a holder;

a tobacco tray positioned in a bottom section of the holder, wherein the tobacco tray is in the form of a drawer to enable insertion and removal of the tobacco tray from the holder thereby facilitating quick replacement of a tobacco; and a charcoal container, comprising a plurality of knobs arranged on an outer surface of the charcoal container, provided with threads for screwing the charcoal container on the holder and for regulating the distance of the charcoal container from the surface of the tobacco tray.

2. The hubble-bubble device of claim 1, wherein at least one of the holder and the charcoal container is made of ceramic material.

3. The hubble-bubble device of claim 1, wherein the tobacco tray is made of at least one of a ceramic material and a metal.

* * * * *